US006186196B1

(12) United States Patent
Leigh

(10) Patent No.: US 6,186,196 B1
(45) Date of Patent: Feb. 13, 2001

(54) REFUELLING SYSTEM

(75) Inventor: Arthur Donald Leigh, Melbourne (AU)

(73) Assignee: National Valve & Engineering Co. Pty. Limited, Hallam (AU)

( * ) Notice: Under 35 U.S.C. 154(b), the term of this patent shall be extended for 0 days.

(21) Appl. No.: 09/380,848

(22) PCT Filed: Jul. 15, 1996

(86) PCT No.: PCT/AU96/00446

§ 371 Date: Sep. 1, 1999

§ 102(e) Date: Sep. 1, 1999

(87) PCT Pub. No.: WO97/03917

PCT Pub. Date: Jun. 2, 1997

(30) Foreign Application Priority Data

Jul. 14, 1995 (AU) ..... PN4148/95

(51) Int. Cl.[7] ..... B65B 1/04; B65B 3/04; B65B 37/00; B67C 3/00

(52) U.S. Cl. ..... 141/231; 141/94; 141/279; 141/387; 141/388; 244/135 A; 137/342

(58) Field of Search ..... 141/387, 388, 141/279, 94, 231; 137/342, 615; 244/135 A, 135 R

(56) References Cited

U.S. PATENT DOCUMENTS 4,394,027 * 7/1983 Watkins, Jr. ..... 280/5 C
5,141,178 * 8/1992 Alden et al. ..... 244/135
5,505,237 * 4/1996 Magne ..... 141/388

FOREIGN PATENT DOCUMENTS 4886685 4/1986 (AU) .
6264186 3/1987 (AU) .
5936494 10/1994 (AU) .

* cited by examiner

*Primary Examiner*—Timothy L. Maust
(74) *Attorney, Agent, or Firm*—Edwin D. Schindler

(57) ABSTRACT

A refuelling system for use with an aircraft, and a related a hand-held control apparatus for use in an aircraft refuelling system. The hand-held control apparatus for use in the aircraft refuelling system is intended for use in refuelling systems in which fuel is delivered to an aircraft from a location remote from the aircraft via a refuelling nozzle at an end of a hose, which is wound upon a hose reel at the remote location. The hand-held control apparatus, includes a control trigger for transmitting of an activation signal for activating a refuelling process, so that fuel is delivered from the refuelling nozzle at the end of the hose to the aircraft, along with a device for transmitting a fault signal for shutting down fuel delivery. Additionally, included is device for changing the control trigger from transmitting the activation signal to a hose reel re-wind mode, so that activating the control trigger causes a signal to be transmitted for effecting a re-wind of the hose reel. An operator carrying the refuelling nozzle and holding the hand-held control apparatus is able to move toward the remote location as the hose to the aircraft is being re-wound.

12 Claims, 7 Drawing Sheets

REFUELLING SYSTEM

BACKGROUND TO THE INVENTION

Figure 1:
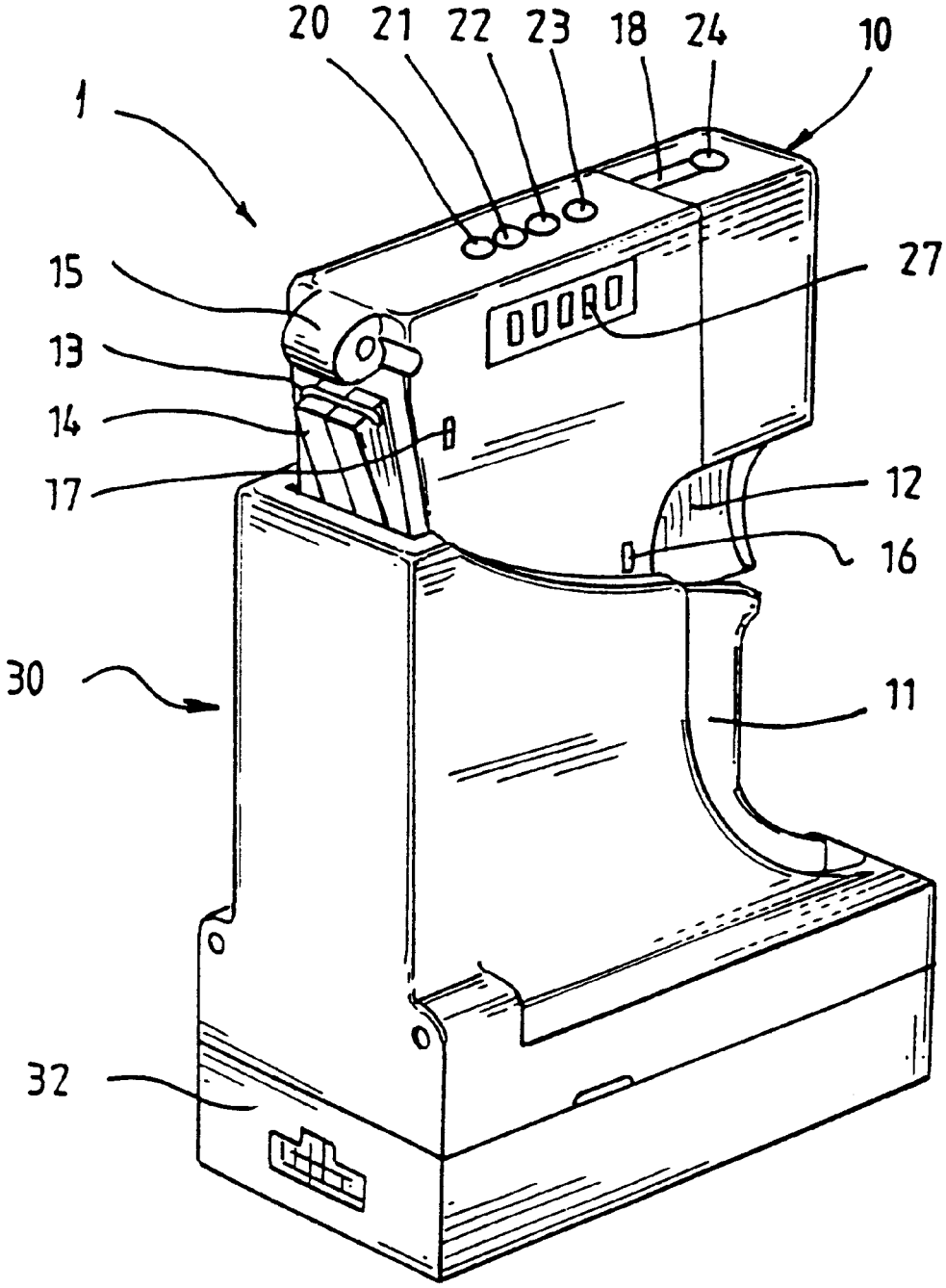

This invention relates to a refuelling system which is particularly adaptable for use whilst refuelling aircraft, but could have applications in other areas, for example, in the refuelling of water and other land vehicles.

For ease of description, however, we shall describe the invention when applied to aircraft refuelling.

Aircraft refuelling is done in a number of different ways. For example, the fuel may be provided either from a hydrant system which is underground in the area of the airport where refuelling occurs, and in which the fuel is maintained under pressure, or from a tanker in which the fuel is carried and which has a self-contained pump to enable the fuel to be pumped from the tanker to the aircraft.

Depending on the aircraft type, refuelling can sometimes be done from the ground but, in some aircraft, it is necessary for the refueller to lift the refuelling hose and nozzle a substantial distance, often by using a mechanically raised work platform or steps.

It has been conventional in refuelling systems to provide the refueller with a deadman control handle device which necessitates an action by the refueller within certain prescribed time periods to ensure that refuelling continues, but, at the same time, to ensure that the refueller is aware and alert.

Conventionally, these devices have been connected to the refuelling apparatus by means of a cable or the like, but there have been proposed systems where the device is separate from the apparatus.

Generally in a refuelling operation, the refueller connects an earth to the aircraft before connecting the filling nozzle, to avoid any likelihood of sparks which might ignite the fuel.

As a matter of course, this earth cable is connected to the aircraft at all times whilst the nozzle is connected, that is, it is connected before the nozzle is connected and disconnected after the nozzle is disconnected.

This is normally done by a conductor which is connected back to the refuelling vehicle, but which may be associated with the filling hose.

It will be appreciated, particularly where high level refuelling is required, that there can be a substantial length of hose in use and this is normally held on a reel in the refueller's vehicle.

The normal practice is that, when refuelling is finished, the refueller carries the nozzle, which is relatively expensive, back to the vehicle and then initiates the spool rewind.

The hose is then rewound and, over a substantial part of its distance, is being brought back over itself until the final length of hose is taken up on the reel and the nozzle is either held on the reel or can be clipped or otherwise held to the vehicle.

Whilst, theoretically, this is the way in which the device is operated, practically, on many occasions, a refueller can simply leave a nozzle on the ground, walk back to his vehicle, and operate the rewind, with the consequent possible damage or, if not accidental damage, marking and otherwise detrimental effect on the nozzle itself.

SUMMARY OF THE INVENTION

The object of the present invention is to provide a refuelling system which has a primary function to act as a deadman handle and which has safety features which are advantageous over refuelling systems previously proposed.

The invention, in its broadest sense, comprises a refuelling system in which there is an operator-actuated device which is in communication with a vehicle or some other part of the system and which has a first function to act to refuel a vehicle, a second function whereby if there is some fault in the system the operator can cause a shut-off of the system and a third function whereby the operator can rewind the hose reel from a remote position.

BRIEF DESCRIPTION OF THE DRAWING FIGURES

In order that the invention may be more readily understood, we shall describe one particular form of the device of the invention and its method of operation in relation to the accompanying figures.

Figure 3:
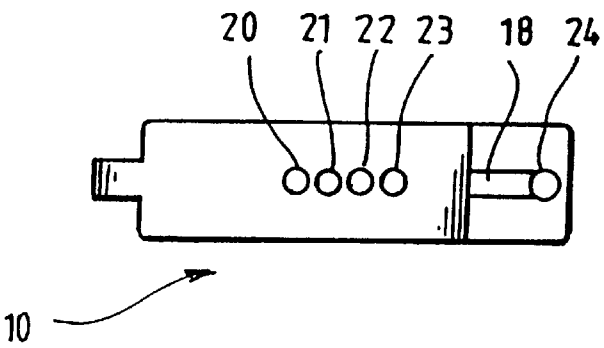
Figure 2:
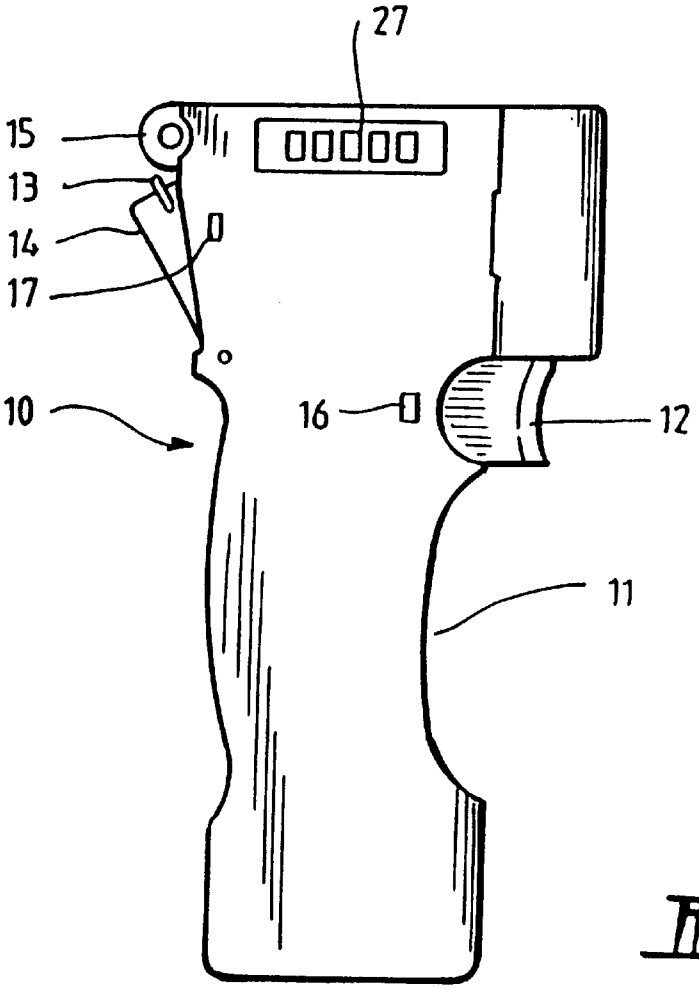
Figure 6:
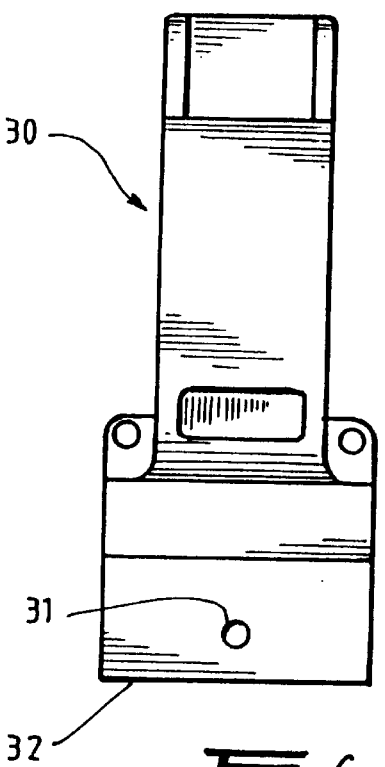
Figure 5:
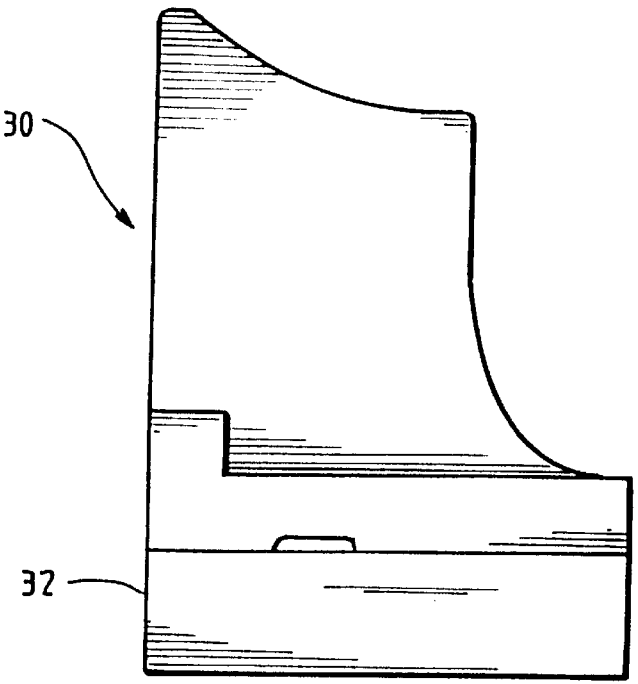
Figure 4:
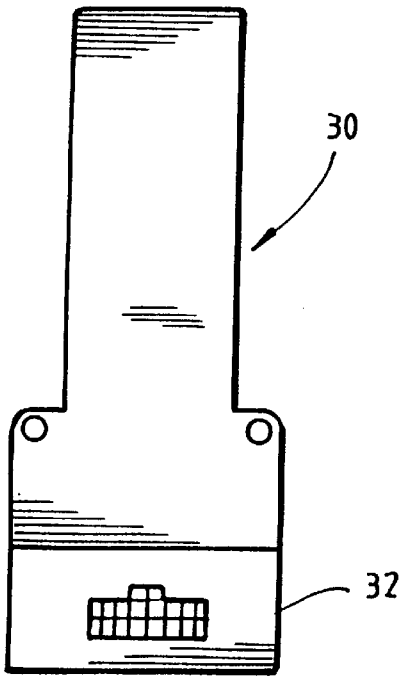
Figure 7:
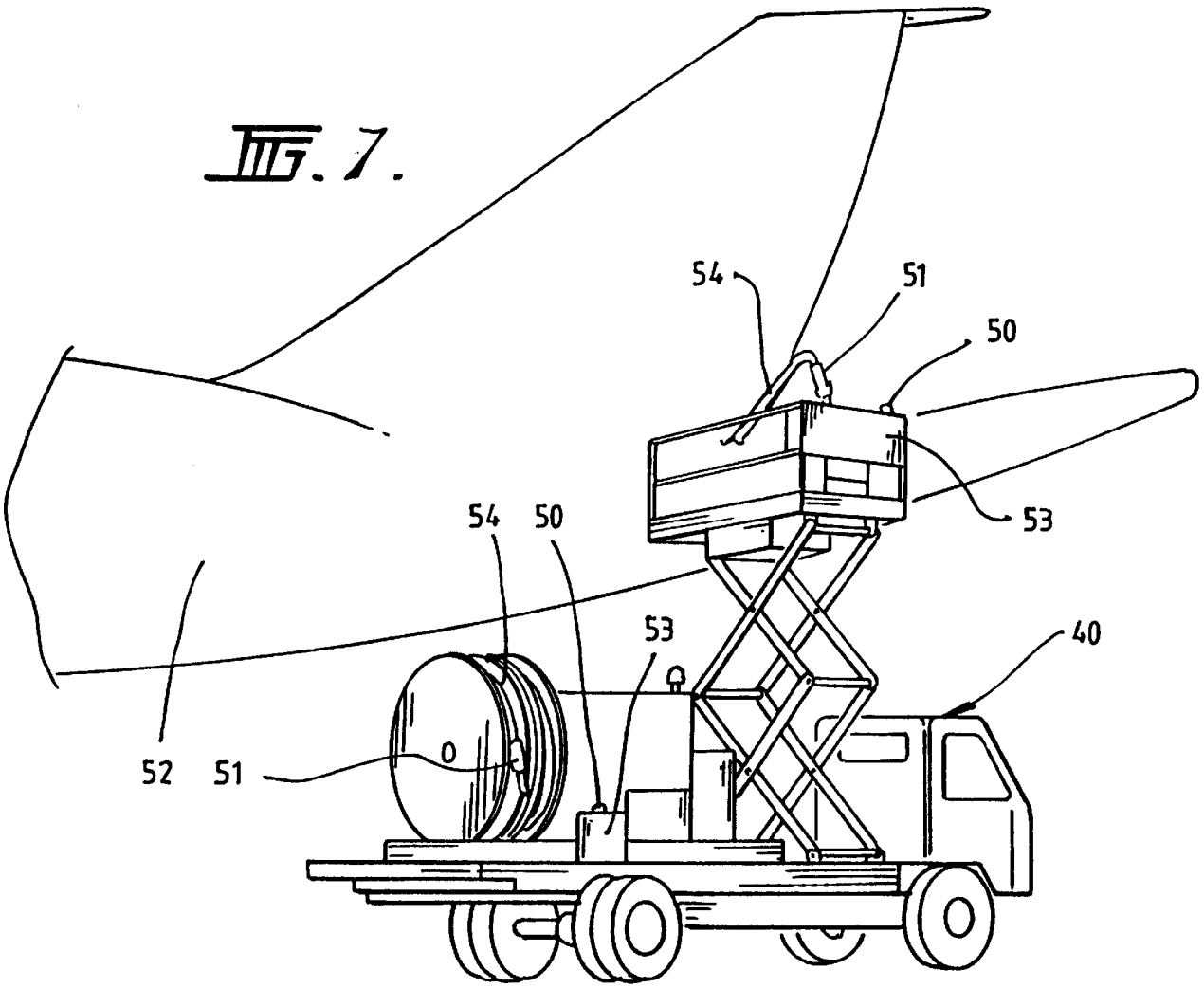
Figure 8:
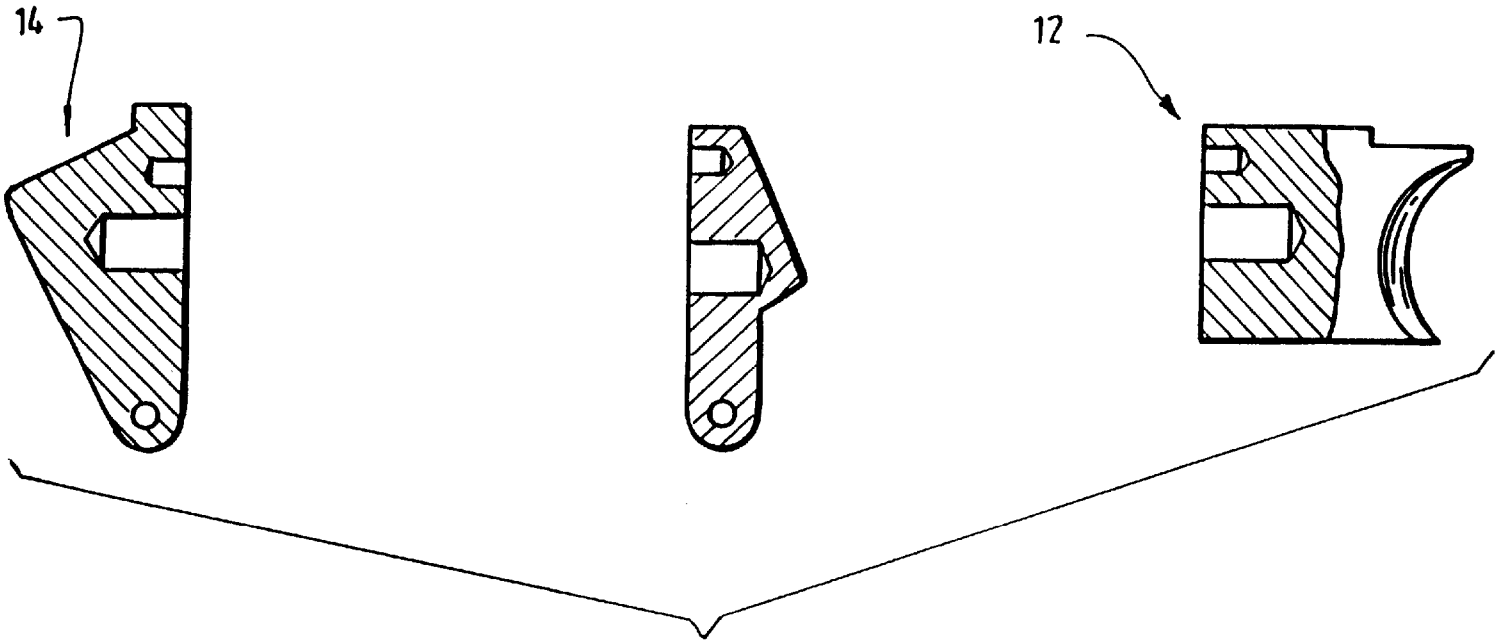
Figure 9:
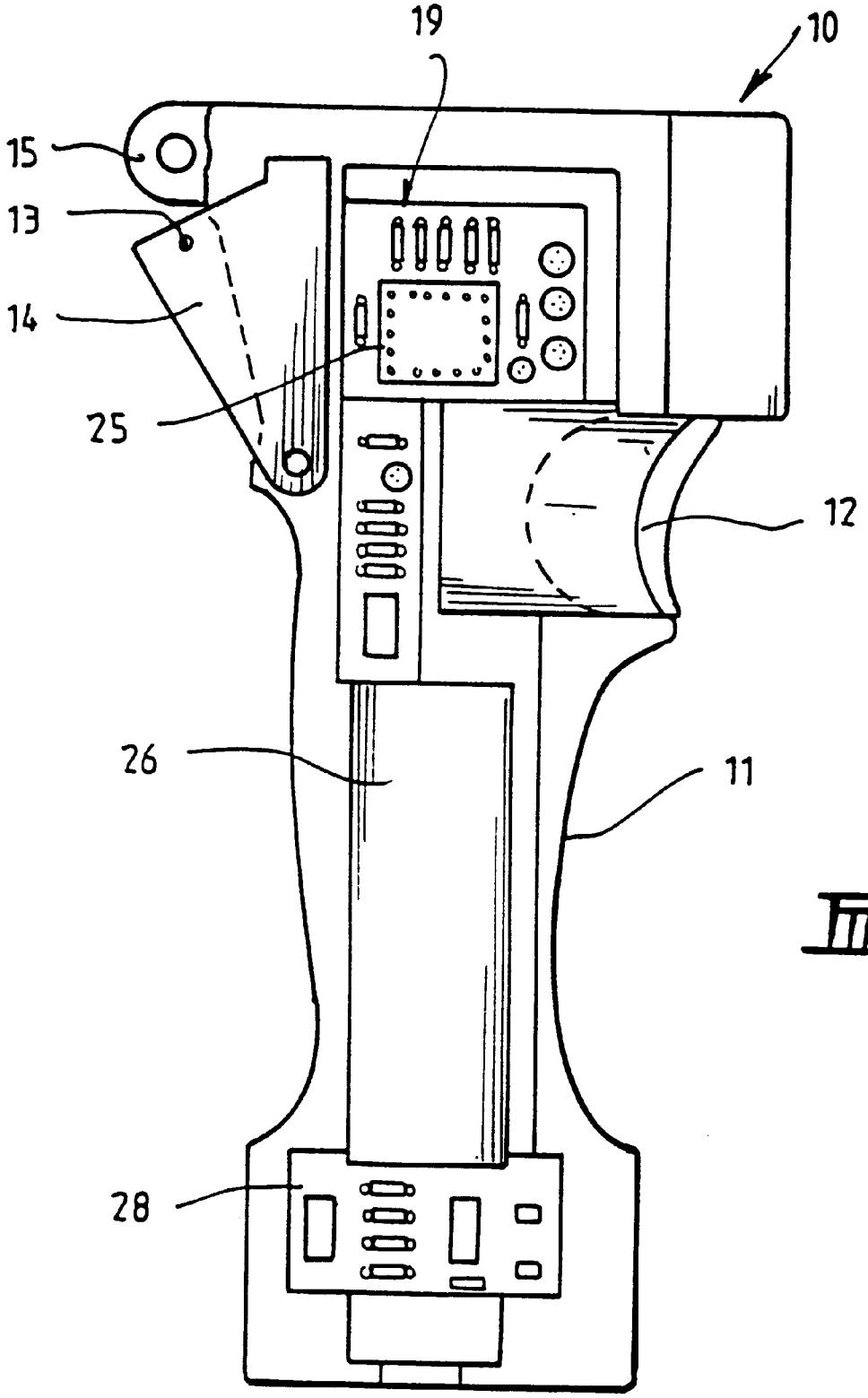
Figure 10:
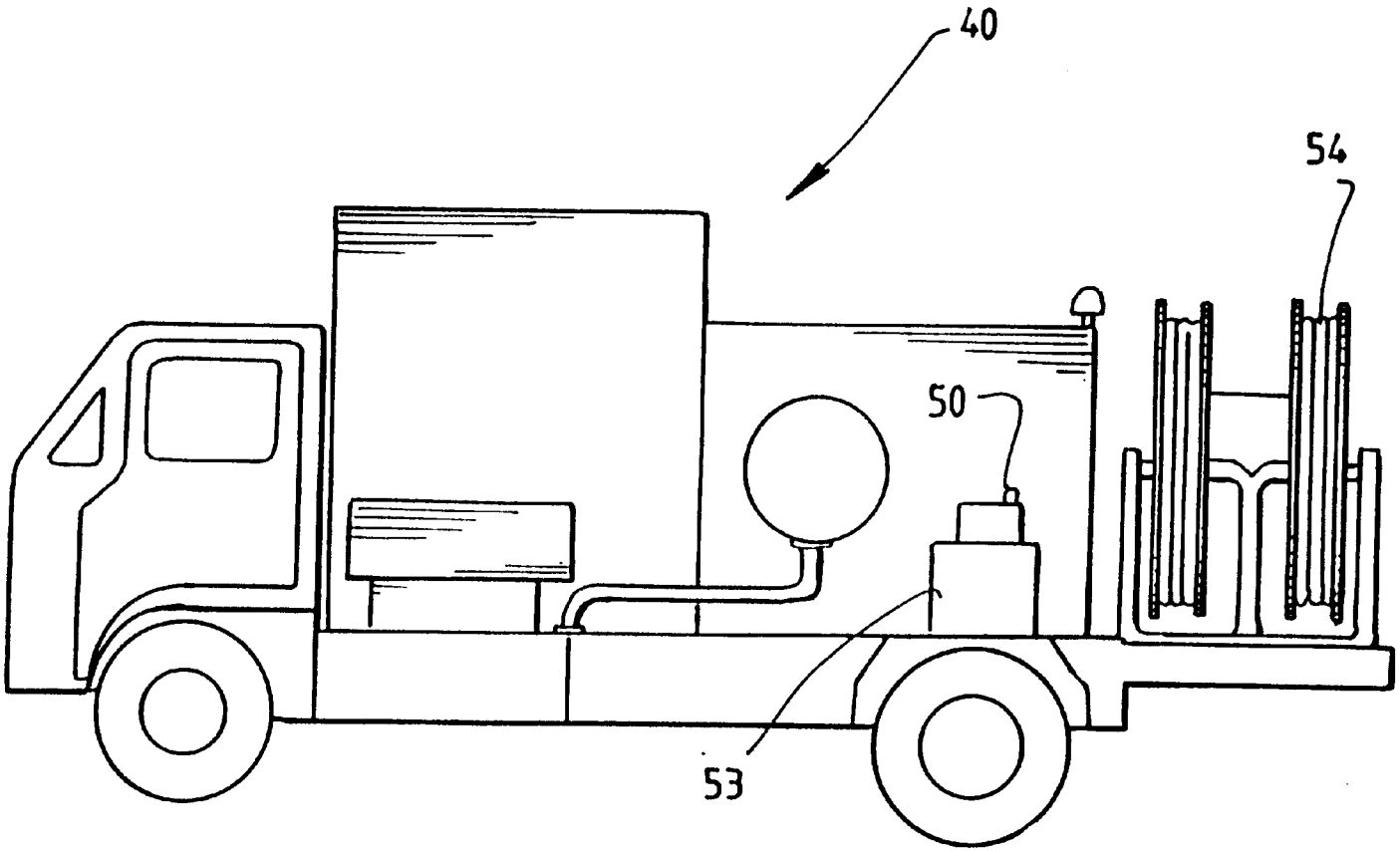

FIG. 1. is a perspective view of the device;

FIG. 2. is a side view of the remote unit, showing the components necessary for the operation of the device as defined in this specification;

FIG. 3. is a top view of the device, showing the LED function display lights and other components of the unit;

FIG. 4. is a rear view of base station;

FIG. 5. is a side view of base station;

FIG. 6. is a front view of the base station;

FIG. 7. is a perspective view of an aircraft with a nozzle accompanied by a ground pin and an earth;

FIG. 8. is a front view of switches;

FIG. 9. is a front view of deadman timer;

FIG. 10. is a perspective view of Vehicle and beacon.

DETAILED DESCRIPTION OF THE DRAWING FIGURES

Physically, the device 1 may be of any required form, but it is preferred that it has a remote unit 10 with a handle 11 which is relatively easily held by the operator, and in the preferred form of the device, there may be three switches 16, 17 and 18 associated with the handle 11, although if required, the operation of these may all be effected by a single control trigger 12.

The switches 16, 17 and 18 may preferably be Hall effect switches which need no physical connection with the actuating member, which can be a magnet or the like which is brought into or moved from a position relatively close to the switch to cause operation thereof. Instead of a Hall effect switch, we could alternatively use a magnetically operated reed switch or the like. The main feature is that the switch be physically embedded in the device 1 and the operating means be remote therefrom.

The device has a main control trigger 12 which when depressed actuates the refuelling process and initiates operation of the Deadman timer 19. In order to effect this operation, we provide a transmitter 25 in the remote unit, whicn transmitter is coded to operate with a receiver 32 located in the base station 30 in the refueller's vehicle 40 so that when this coded signal is transmitted, the delivery system continues to be activated.

When the trigger 12 is depressed, a beacon 41 incorporated on the vehicle 40 illuminates and after 90 seconds will commence flashing. To ensure the operator's attentiveness if the refuelling trigger 12 is not momentarily released and re-activated within 30 seconds, the refuelling process is terminated.

A small green LED 23 contained in the body of the remote unit 10 duplicates the vehicle beacon 41 operation, providing the operator with a visual indicator in the handle.

For safety the base station contains a duplicate deadman timer 19 to the one contained in the remote unit 10. If either deadman timer 19 is not reset in the required period, the properly coded signal will not be received and the refuelling process will be terminated.

It will be appreciated that in, say, busy airports, there may be a number of refuellers operating at the same time so the transmitted coded signals must be unique. A further discussion of this will be included later herein.

A second function can be to provide a cut-off of the refuelling system in a fault situation.

This can be particularly useful in hydrant-type systems where, if there is a fault in the actual system itself up to the hydrant or the point of connection to the hydrant, then this cannot normally readily be controlled by a refueller.

In the present arrangement, a second switch 17 can be actuated under these circumstances.

It is preferred that the second switch 17 has some form of interlock, possibly a safety pin 13 or the like, so that it cannot inadvertently be operated, but when the fault condition arises, the operator can physically withdraw the pin 13 and press the shutdown button 14 in conjunction with the main control trigger 12.

When the switch 17 is activated, a separate coded signal is transmitted to the receiver 32 in the vehicle 40 or other part of the system and this, in turn, can send a further signal to effect a control function. If the system is a hydrant system, this further control signal is transmitted to the airport terminal system as an emergency signal. The airport authorities can determine the action to be taken in these circumstances but could close valves or shut down the pumps of the hydrant system. That is to say, the liquid in the lines is no longer under pressure and, whilst there may be a further leakage of liquid, depending upon the capacity of the lines, this will be restricted.

If the system is being used with a tanker type refueller the device can be used to, say, initiate shut-off valves in the compartment or compartments of the tanker to prevent any further fuel being delivered.

In a third application, the device can be used to initiate a hose rewind operation.

Hosereel rewind is actuated by inserting a ground pin 50 into the ground pin insertion point 24 and then depressing the main control trigger 12. The insertion of the pin 50 into the ground pin insertion point 24 changes the functionality of the main control trigger 12 to the hosereel mode of the operation and provides a signal which commences the rewinding operation.

The hosereel rewind function of the device cannot be inadvertently initiated whilst there is physical connection of the nozzle 51 with the aircraft 52.

In use, the operator can disconnect the nozzle 51, disconnect the earth 53, insert the ground pin 50 associated therewith to the ground pin insertion point 24, thus making the third switch 18 ready and, on operation of this switch 18, and again, this may well be by operation of a single member once the switch 18 has been initiated, the take-up reel mechanism will operate and the refueller can carry the nozzle 51 as he walks back to the vehicle 40 with the hose 54 being reeled in as he walks. That is, there should be no reason for the operator to put the nozzle 51 down, so the nozzle 51 is maintained in a desirable condition.

The physical arrangement of the of the device contains LED function display lights 20, 21, 22 and 23.

There can be four of these LED function display lights;

A green LED 23 to indicate that the refuelling switch 16 and deadman timer 19 has been actuated and that fuelling is taking place. After one minute the LED 23 will flash, prompting the operator to momentarily release and re-activate the switch 16 by means of releasing and depressing the main trigger 12;

A red LED 20 to indicate that an emergency shutdown has been activated;

A blue LED 21 to indicate that the hose-reel rewind has been actuated;

A yellow LED 22 is used to indicate the battery 26 condition. If the LED 22 is flashing, the battery 26 needs re-charging.

The base station provides a red LED 31 for correct operation.

We provide, in the refuelling vehicle, a base station 32 for the remote unit 10 and this station 32 effects two functions. Firstly, it has means whereby the internal battery 26 of the remote unit 10 can be charged by inductive charging, that is, there is again no physical connection to the interior of the remote unit 10 and secondly, it ensures that the remote unit 10 is encoded to the particular device 1. That is, regardless of which remote unit 10 is loaded into the base station 30, it will be automatically encoded to operate with the particular refuelling vehicle. That is, should an operator misplace or damage a remote unit 10, any other available remote unit 10 can be used once it has been re-encoded. Also, as will be mentioned hereinunder, because the remote unit 10 is not repairable when there is a breakdown, either due to physical damage, failure of the battery 26 to charge, or an electronic breakdown, which is unlikely, then the unit can simply be discarded, a further remote unit 10 can simply be placed into the base station 30 and re-encoded. There is thus no effective period during which the particular refuelling vehicle cannot be used. Similarly, if a refueller should leave the area with the remote unit 10, an alternative remote unit 10 could be used.

As explained above the device 1 has its unique digital signature that is provided between the remote unit 10 and the base station 30 to ensure system integrity. This signature is verified and reprogrammed into the remote unit 10 each time the unit 10 is replaced in the base station 30 for recharging. This provides a facility enabling the remote unit 10 to be reprogrammed.

The reprogramming cycle can be completed in less than 3 seconds. The base station 30 detects an additional current drain when the remote unit 10 is inserted and inductively initiates a signature reprogram and verification cycle with the remove unit 10. A transmitter 25 in the remote unit 10 transmits the new signature back the base station 30 and once verified by the base station 30, the recharging cycle is initiated.

It is preferred that the remote unit 10 uses a re-chargeable 3.6V nickel hydride battery 26 that has a minimum battery duration of six hours, however the device may be adapted during manufacture to have a power source of any available means, for example, 1.5V, 3V, 6V or 9V battery, solar battery, or mains power.

Normally the battery 26 of the remote unit 10 will be quite sufficient for use, particularly as it is automatically placed on re-charge when it is located in the base station 30 in the vehicle, but if the battery 26 is inadvertently permitted to lose charge. or there is a battery failure, we provide a yellow warning light 22 to provide an indication of this.

We may also provide directly on the remote unit 10 a meter display 27. In effectively all refuelling operations at the present time there is an electronic indication of the quantity of fuel which has been pumped and in this modification we simply provide a second receiver 28 as part of the remote unit 10 which is adapted to receive a signal derived from the signal indicating the quantity pumped and to transform this into driver signals for a liquid crystal display.

Thus, the refueller, without having to check on his vehicle 40 or the like, can obtain an accurate estimate of the amount of fuel pumped at any particular time.

It is preferred that the device may be made of a synthetic plastics material and the electronics, including the power supply, can be embedded in an aperture or apertures within the body and the body may be sealed. That is to say, the device is one which is not repairable and will have to be replaced on malfunction.

The remote control unit is preferably in contact with a base station in the vehicle by means of RF or IR signals.

The nominal distance of the remote control unit from the base station is 30 meters, however in this invention all distances, timings, frequencies, on-off flash rates are subject to variation.

Whilst, in this specification, we have described one particular form of refuelling device and its associated system, it will be appreciated that the functions we have selected may be varied, depending upon the particular requirements of the operator and if required, further functions could be provided.

What is claimed is:

1. A hand-held control apparatus for use in an aircraft refuelling system, in which fuel is delivered to an aircraft from a location remote from the aircraft via a refuelling nozzle at an end of a hose that is wound upon a hose reel at the remote location, said hand-held control apparatus comprising:

a control trigger for transmitting of an activation signal for activating a refuelling process so that fuel is delivered via the refuelling nozzle at the end of the hose to the aircraft;

means for transmitting a fault signal for shutting down fuel delivery; and, means for changing said control trigger from transmitting said activation signal to a hose reel rewind mode, so that activating said control trigger causes a signal to be transmitted for effecting a rewind of said hose reel, whereby an operator carrying the refuelling nozzle and holding said hand-held control apparatus is capable of moving toward the remote location as the hose to the aircraft is being re-wound.

2. The hand-held control apparatus for use in an aircraft refuelling system according to claim 1, further comprising a deadman timer activated by said control trigger, so that said deadman timer is active during refuelling.

3. The hand-held control apparatus for use in an aircraft refuelling system according to claim 2, further comprising means for ensuring that if said control trigger is not momentarily released and re-activated within a specified period of time, as governed by said deadman timer, that the refuelling process is terminated.

4. The hand-held control apparatus for use in an aircraft refuelling system according to claim 1, wherein said means for transmitting a fault signal for shutting down fuel delivery includes a switch device.

5. The hand-held control apparatus for use in an aircraft refuelling system according to claim 1, wherein said means for transmitting a fault signal for shutting down fuel delivery includes a safety pin and a shutdown button.

6. The hand-held control apparatus for use in an aircraft refuelling system according to claim 5, wherein said safety pin includes means for allowing said safety pin to be physically withdrawn from said hand-held control apparatus, and said shutdown button is able to be depressed in conjunction with said control trigger for effecting emergency shutdown.

7. The hand-held control apparatus for use in an aircraft refuelling system according to claim 1 further comprising a ground insertion point, for which when a pin is inserted into said ground insertion point, in conjunction with depression of said control trigger, the hose is re-wound upon the hose reel.

8. A refuelling system, comprising:

an operator-actuated device having means for refuelling a vehicle, said means for refuelling including a hose with a hose reel;

means for detecting a fault in said means for refuelling, including means shutting-off said means for refuelling upon detecting a fault;

means for allowing an operator of said refuelling system to rewind the hose reel of said means for refuelling from a remote position;

a deadman timer activated by said operator-actuated device so that said deadman timer is active during refuelling; and, means for ensuring that if said operator-actuated device is not momentarily released and re-activated within a specified period of time, as governed by said deadman timer, that the refuelling process is terminated.

9. A refuelling system, comprising:

an operator-actuated device having means for refuelling a vehicle and a safety pin and a shutdown button, said means for refuelling including a hose with a hose reel;

means for detecting a fault in said means for refuelling, including for means for shutting-off said means for refuelling upon detecting a fault; and, means for allowing an operator of said refuelling system to rewind the hose reel of said means for refuelling from a remote position.

10. The refuelling system according to claim 9, wherein said safety pin includes means for allowing said safety pin to be physically withdrawn from said hand-held control apparatus, and said shutdown button is able to be depressed in conjunction with said control trigger for effecting emergency shutdown.

11. A refuelling system, comprising:

an operator-actuated device having means for refuelling a vehicle, said means for refuelling including a hose with a hose reel, said operator-actuated device including a ground insertion point, for which when a pin is inserted into said ground insertion point, in conjunction with actuation of said operator-actuated device, the hose is re-wound upon the hose reel;

means for detecting a fault in said means for refuelling, including for means for shutting-off said means for refuelling upon detecting a fault; and, means for allowing an operator of said refuelling system to rewind the hose reel of said means for refuelling from a remote position.

12. A refuelling system, comprising:

an operator-actuated device having means for refuelling a vehicle, said means for refuelling including a hose with a hose reel;

means for detecting a fault in said means for refuelling, including for means for shutting-off said means for refuelling upon detecting a fault;

means for allowing an operator of said refuelling system to rewind the hose reel of said means for refuelling from a remote position;

a deadman timer activated by said operator-actuated device so that said deadman timer is active during refuelling;

a beacon for illuminating when said deadman timer is activated, said beacon commencing illumination after a predetermined period of time for indicating to the operator to reactivate said operator-actuated device and means for refuelling.

* * * * *